US005345742A

United States Patent [19]

Rogowsky et al.

[11] Patent Number: 5,345,742

[45] Date of Patent: Sep. 13, 1994

[54] FORCE TRANSFER BODY FOR AN ANCHORAGE

[75] Inventors: David Rogowsky, Belp; Erwin Siegfried, Liebefeld, both of Switzerland

[73] Assignee: VSL International AG, Bern, Switzerland

[21] Appl. No.: 33,300

[22] Filed: Mar. 17, 1993

[30] Foreign Application Priority Data

Mar. 24, 1992 [EP] European Pat. Off. ..... 92810216.9

[51] Int. Cl.[5] ..... E04C 5/12

[52] U.S. Cl. ..... 52/698; 52/223.13; 29/452

[58] Field of Search ..... 52/223.13, 698; 29/452; 254/29 A

[56] References Cited

U.S. PATENT DOCUMENTS

| | | | |
|---|---|---|---|
| 2,371,882 | 3/1945 | Freyssinet | 254/29 A |
| 2,609,586 | 9/1952 | Parry | 29/452 |
| 3,412,511 | 11/1968 | Dietrich | 254/29 A |
| 3,447,784 | 6/1969 | Launay | 254/29 A |
| 4,449,855 | 5/1984 | Langwadt | 52/223.13 |

FOREIGN PATENT DOCUMENTS

| | | |
|---|---|---|
| 1752167 | 8/1968 | Australia . |
| 1124220 | of 1962 | Fed. Rep. of Germany . |
| 2423741 | 11/1975 | Fed. Rep. of Germany . |
| 2628777 | 3/1988 | France . |
| 894240 | of 1962 | United Kingdom . |
| 948094 | of 1964 | United Kingdom . |
| 1103345 | of 1968 | United Kingdom . |

*Primary Examiner*—James L. Ridgill, Jr.
*Attorney, Agent, or Firm*—Oldham, Oldham & Wilson Co.

[57] ABSTRACT

The force transfer body comprises a first, essentially annular partial body, preferably of cast steel, and a second partial body, preferably of a castable mortar mass capable of hardening. The second partial body is cast in one piece with the first partial body. An inner conical aperture is lined with a funnel-shaped plastic part, which overlaps at least a section of the first partial body. The first partial body has an abutting surface, turned away from the part of the structure, serving the firm contact with an anchor head containing individual members. The prestressing forces arising concentratedly with the anchorage are conveyed from the anchor head via the first partial body into the second partial body, and from there into the part of the structure. The second partial body is designed essentially frustoconical, the truncated cone extending, tapering, away from the first partial body. In the area of the outer generated surface of the second partial body there is a circumferential constriction. Achieved thereby, on the one hand, is the provision of an annular surface, formed by the circumferential constriction, to convey the prestressing forces to the part of the structure, in addition to the smaller face turned away from the first partial body. The specific compressive stress on the concrete of the part of the structure is thereby decreased. Thanks to this particular construction and given shape, the inventive force transfer body can be realized more easily, compared to bearing plates, poured anchor bodies or prior art anchor bodies.

15 Claims, 5 Drawing Sheets

FORCE TRANSFER BODY FOR AN ANCHORAGE

The present invention concerns a force transfer body for an anchorage, in particular for a stressing anchor, intended for concreting in a concrete part of the structure, with an abutting surface serving the firm contact with an anchor head containing individual members, the force transfer body comprising at least two partial bodies, a first essentially annular partial body on which the abutting surface is provided and a second partial body which is disposed on the side of the first partial body facing away from the abutment side, the second partial body having the form of a hollow body with an outer surface and an inner generated surface, and the outer surface being divided into two essentially annular faces and an outer generated surface.

With an anchorage, for example a stressing anchor in a concrete part of the structure, the dimensioning of force transfer zones is of special importance. With a prestressing tendon, which can comprise one or more individual members, the prestressing forces present in the prestressed state are transmitted in concentration to the part of the structure by means of at least one stressing anchor, after prestressing of the prestressing tendon is accomplished, following hardening of the concrete of the part of the structure. The prestressing tendon can run thereby outside the part of the structure to be prestressed or can be disposed within this part. In the latter case a subsequent bonding of the prestressing tendon with the prestressed part of the structure can also be foreseen. Ordinarily the one end of the prestressing tendon, whose individual member or members consist of wires, strands, rods of steel or the like, are held fast in the stressing anchor. This stressing anchor comprises in many cases a bearing plate of steel, which lies on the part of the structure to be prestressed or is embedded therein, and an anchor head, likewise of steel, with conical holes to receive clamping wedges; through the former and the latter are led the individual members to be prestressed of the prestressing tendon. Following the pretensioning step, the bearing plate has to transmit the prestressing forces to the part of the structure. The bearing plate, normally of square design, has to be dimensioned in such a way that a bending of the bearing plate is limited such that nearly uniform force transfer to the part of the structure can be ensured. To fulfil this requirement bearing plates so far have been designed of great thickness and correspondingly great weight.

Often employed as a substitute for the aforementioned bearing plates, are cast anchor bodies, so-called castings. These form, like a trumpet, the transition of the fanned out individual members, held fast in the anchor head, to the individual members, collected together, running through a duct. They have at least one circumferential bulge extending radially outward, which serves to convey prestressing forces to the part of the structure in addition to a frontal force transfer surface. As a result of this given shape, the casting is lighter than the previously mentioned bearing plate of steel.

So-called anchor bells have also been proposed to save weight. These comprise a hollow, cylindrical steel body, which is embedded in concrete in the part of the structure to be prestressed. In the concreting step, a recess is left open concentrically inside the anchor bell, the bell put into the formwork. This recess is for later reception of a so-called anchor disk which fulfils the function of the previously mentioned anchor head. Provided around the anchor bell as additional reinforcement is a so-called spiral reinforcement to absorb the expansion forces which, with all anchorages, arise in the part of the structure with the introduction of forces. The anchorage mentioned here requires the same concrete as the part of the structure to be created. Putting this concrete into the hollow space of the anchor bell as desired without bubbles during concreting of the part of the structure presents considerable problems. This putting in of concrete is hindered in addition by the spiral reinforcement, disposed around the anchor bell, as well as by the other reinforcement parts. Thus it is not easily ensured that the anchor disk or anchor head does not penetrate into the concrete during or after prestressing.

A further type of stressing anchor is presented in the book Spannbeton für die Praxis by Dr. Ing. Fritz Leonhardt, third edition, 1973, illustration 3.75. The construction is such that around a steel anchorage body, in which individual members can be anchored, a concrete body in a cone shell made of steel sheet is concreted in. The concrete body is placed on the completed part of the structure prior to the prestressing step and serves the transmission of prestressing forces to the building during and after stressing. In practice this stressing anchor has not stood up to the test.

In the patent specification GB 1 103 345 an anchorage body is disclosed which is intended for concreting in a part of the structure. It comprises a metal ring with an abutting surface for an anchor head and a conical concrete body, which, embedded between an outer conical wire coil and an inner metal pipe, connects to the side of the metal ring turned away from the abutting surface. The outer diameter of the anchorage body increases continuously starting from the metal ring out. The largest diameter is situated at the end of the anchorage body lying completely within the interior of the part of the structure. The concrete body is harder than the concrete of the part of the structure.

Such an anchorage body is relatively heavy. Disadvantageous is that a high compressive stress peak arises on the peripheral edge of the concrete body face turned away from the metal ring, following the pretensioning of the prestressing tendon anchored to the anchorage body.

It is the object of the present invention to propose a body, improved over the state of the art, which is lighter than the said bearing plate, the said casting as well as the anchorage body disclosed in the cited specification, and which serves the transmission and introduction of prestressing forces into a part of the structure. A secure, sufficiently strong support for the anchor head should be ensured. The force transfer body according to the invention should be constructively designed so that the forces to be transferred are capable of being fully absorbed and passed into the part of the structure. Improved force transfer should be achieved.

This object is fulfilled by a force transfer body wherein the outer generated surface essentially represents the shell of a truncated cone whose larger face is turned towards the first partial body and wherein the outer generated surface has at least one radially circumferential constriction, an annular surface being formed by the circumferential constriction which, in addition to the smaller face, serves to convey the prestressing forces to the part of the structure.

The inventive force transfer body is conceived as a so-called composite body. It comprises a first preferably metallic partial body, which fits closely to a second partial body of a preferably non-metallic material. The first partial body is intended to absorb the prestressing forces from the anchor head and convey them to the second partial body. The second partial body then conveys the absorbed prestressing forces to the part of the structure. The materials of both partial bodies and the active areas on which the forces are conveyed are harmonized with one another. Understood as active areas are those sections of the outer generated surface of the second partial body which are penetrated by lines of force. The circumferential constriction has the effect that the transmission of the prestressing forces to the part of the structure does not have to take place solely over the smaller face and that on the second partial body inside the part of the structure at least two peripherally encircling edges are present, spaced apart axially. The compressive stress peaks, previously mentioned, are thereby distributed, and thus a more uniform transfer of forces is achieved. A step-by-step transfer of the prestressing force to the concrete of the part of the structure takes place, whereby the stress of the latter is decreased. The bonding with the concrete of the part of the structure is improved, on the other hand. By means of a construction of this type it is possible to achieve a reduction in weight and an improved force transfer to the part of the structure, which is not insignificant, when compared to prior art bearing plates, cast anchor bodies and other anchor bodies.

The given shape of the inventive force transfer body can be chosen in such a way that the difficulties named in connection with the previously mentioned anchor bell are excluded to a great extent.

If the second partial body is constructed according to patent claim 2, it can be achieved that a first active area for absorbing the prestressing forces from the first partial body is smaller than a second active area for conveying the absorbed prestressing forces to the concrete of the part of the structure. The first active area essentially corresponds thereby to the larger face turned toward the first partial body, and the second active area essentially to the sum of the other smaller faces plus the annular surface.

Advantageously the latter is inclined relatively slightly in relation to the longitudinal axis of the force transfer body. The angle of inclination amounts to at most 30° with respect to a plane conceived at right angles to the longitudinal axis of the body. The inclination runs in such a way that the outer circumferential line of the annular surface is spaced farther from the smaller face in the axial direction of the body than the inner circumferential line. Through the said area enlargement, a reduction of the specific pressure load on the concrete on the part of the structure is achieved for a given prestressing force.

Foreseen is that the prefabricated first partial body is cast integrally with the second partial body, or, respectively, that the second partial body is cast in one piece with the first partial body. The outer surface of the second partial body can be provided with indentations, ribs and/or bulges so that a better bonding is attained with the presstressed concrete of the part of the structure. In particular with one (or several) radially circumferential bulge or bulges, the second active area can be enlarged, the specific compressive stress on the concrete of the part of the structure being reduced further. Axially extending ribs disposed in the area of the constriction fulfil the same purpose.

It is intended that the second partial body be made preferably of a castable material capable of hardening, preferably a mortar mass. The strength of the mortar mass lies between the strength of the first partial body and the strength of the concrete of the part of the structure. The strength of the mortar mass is dependent, on the one hand, upon the chosen form of the second partial body and, on the other hand, how far the anchor head extends radially over the abutting surface of the first partial body. A mortar mass is preferably used which has a strength of at least 60 $N/mm^2$ in the hardened state. The material is preferably castable in a cold state. In this case, fewer demands are placed upon the moulds. They can be produced inexpensively. Instead of the mortar mass, another material however could be used too, for example an electrically insulating material.

The second partial body can have supplementary reinforcement elements, in addition to a harmonized mortar mass and a suitable given shape, to adjust the strength relationship of the second partial body to the first partial body and to the concrete of the part of the structure.

An especially suitable embodiment foresees an essentially U-shaped cross-section for the first partial body, the second partial body projecting into the circumferential grove formed by the two sides of the U and the base. Formed on the ring defined by the base of the U is the abutting surface, turned away from the groove. It is advantageous if the outer circumferential collar of the first partial body formed by the outer sides of the U is inclined outwardly away from the ring and encompasses an angle of 10° to 45°, preferably 20° to 30°, to the longitudinal axis of the force transfer body so that the arising expansive forces, which extend from the rim of the anchor head into the part of the structure at an angle of about 45°, can be absorbed without the first partial body having to be overdimensionally designed. To ensure that the outer collar is not deformed during stressing with the prestressing forces, ridges can be provided, running essentially radially, connecting the outer circumferential collar with the inner circumferential collar formed by the inner sides of the U.

Another preferred embodiment foresees that the inner generated surface of the force transfer body is lined with an essentially funnel-shaped plastic part. With its end turned toward the abutting surface, the plastic part overlaps the inner collar of the first partial body at least partially. With its other end it projects out of the force transfer body, and has on this end means of connection to a further funnel-shaped or pipe-shaped plastic part. The two said plastic parts form together a trumpet. Moreover the first said part is provided with fixing means, which are in operative connection with the second partial body and which prevent an axial displacement of the plastic part with respect to the second, or the first partial body, respectively.

The inventive force transfer body can be cast in the building or on the construction site.

BRIEF DESCRIPTION OF DRAWINGS

The invention will now be explained more closely, by way of example, with the aid of drawings in which.

5 is a longitudinal section through a second embodiment of a force transfer body according to the invention.

DETAILED DESCRIPTION OF DRAWINGS

Figure 1:
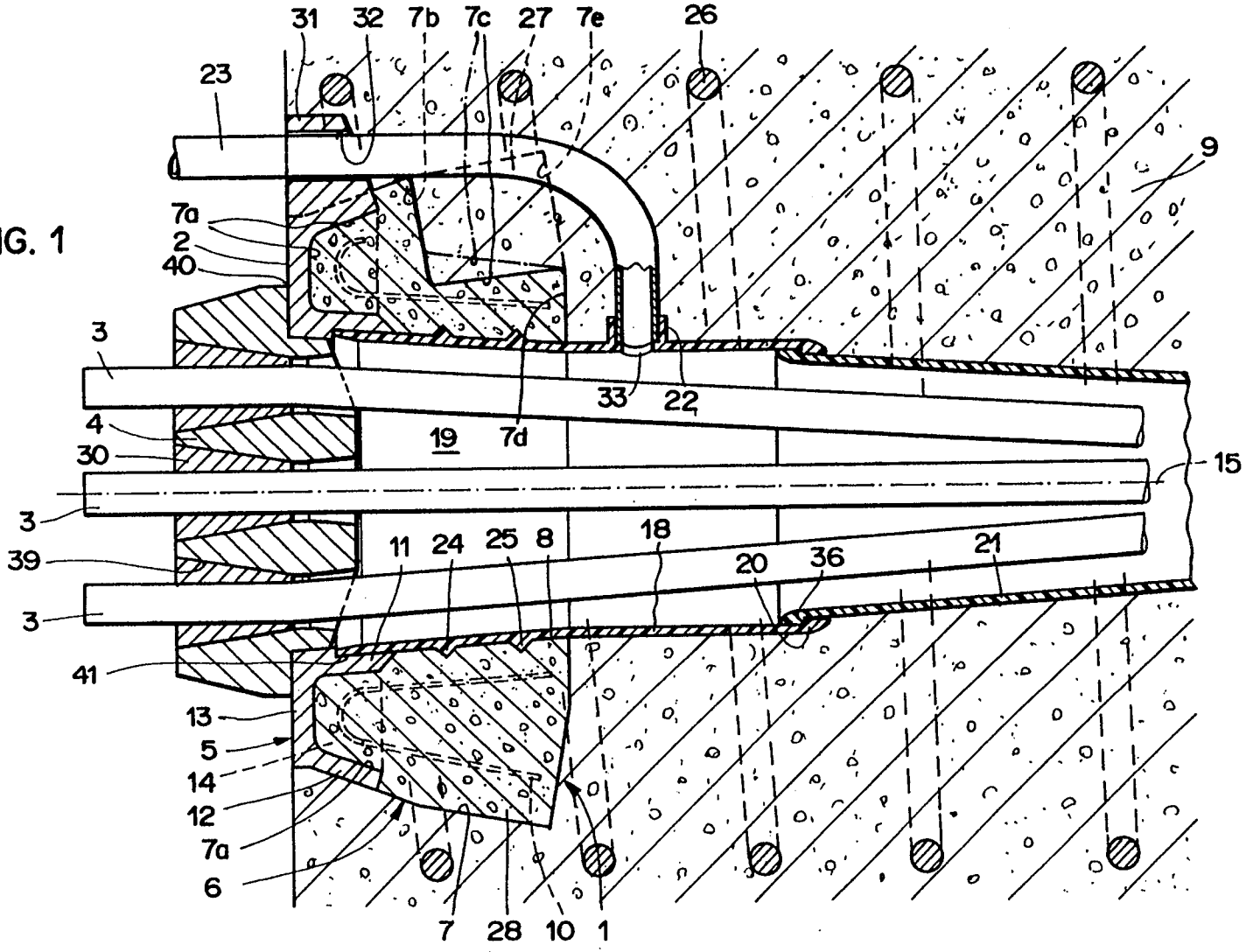
FIG. 1 is a longitudinal section of a first force transfer body in embedded state.
Figure 2:
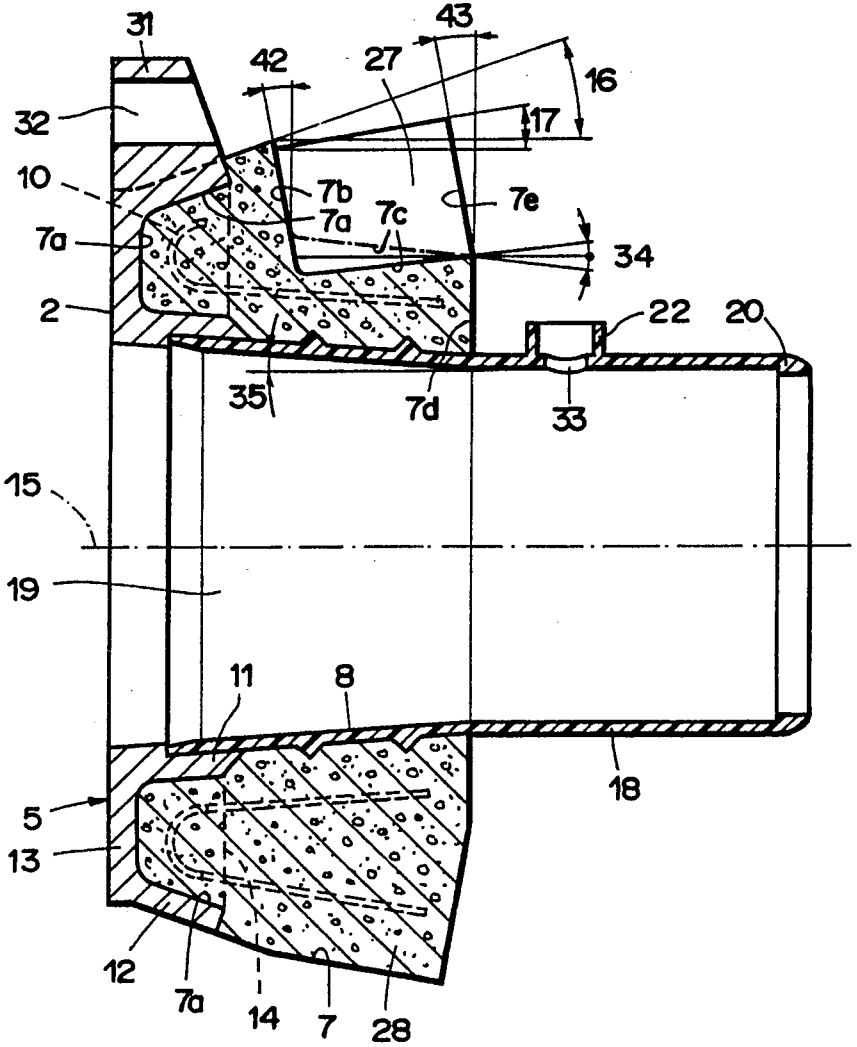
FIG. 2 is a longitudinal section of the force transfer body according to FIG. 1 in removed state.

Presented in FIG. 1 is a longitudinal section through a first embodiment of a force transfer body 1 according to the invention, which is east integrally in a concrete part of the structure 9. The force transfer body comprises a first essentially annular partial body 5 and a second partial body 6, which is connected with first partial body 5. Second partial body 6 consists of a material, preferably a mortar mass, which is castable and capable of hardening. A first partial body 5 made of metal is advantageous. Cast steel is preferred. The annular first partial body has, in a preferred embodiment, an essentially U-shaped cross-section. The two sides of the U form a circumferential inner collar 11 and a circumferential outer collar 12 each. The two collars are turned toward second partial body 6. Defined by the base of the U which connects the two said collars on the side turned away from second partial body 6 is essentially a ring 13, preferably an annulus. The annular surface turned away from second partial body 6 is constructed as a planar abutting surface 2 on which an anchor head designated by the number 4 abuts firmly. The anchor head has one or more conical holes 39, in each of which an individual member 3 of a tension tendon is held in stressed state by means of clamping wedges 30. Each of the inner surfaces, contiguous to one another, of inner collar 11, outer collar 12 and ring 13 circumscribe a circulatory groove, into which the mortar mass of second partial body 6 projects. It is advantageous when outer collar 12 extends outward away from ring 13 so that the prestressing forces or expansive forces, respectively, which extend from an outer edge 40 of anchor head 4 at an angle of approximately 45° into force transfer body 1, can be optimally absorbed. The angle to a longitudinal axis 15 of the force transfer body, which encompasses the outer collar, should amount to 10° to 45°, preferably 20° to 30°. This angle, designated by number 16, is shown in FIG. 2. By means of the fact that the area of second partial body 6 turned toward first partial body 5 is enclosed by first partial body 5 according to the embodiment just described, the tension and expansion forces of first partial body 5 can be optimally transmitted to second partial body 6.

Ridges 14, disposed spaced apart from one another, connecting inner and outer collars 11, 12, can be provided in the said groove of first partial body 5. These ridges serve as reinforcement and counteract a possible deformation of the first partial body in the case of great expansive forces. Ridges 14 are disposed preferably evenly around the circumference.

Force transfer body 1 is normally constructed in such a way that the mortar mass of second partial body 6 is less strong than the preferably metallic first partial body 5. The strength of the mortar mass of second partial body 6 is greater however than that of the concrete of part of the structure 9.

Second partial body 6, which is essentially a frustoconical body generated by rotation in the embodiment example shown, has a conical inner generated surface 8, which opens toward first partial body 5. Second partial body 6 has an outer surface 7, which is divided essentially into two faces 7*a*, 7*d* plus an outer generated surface 7*b*, 7*c*. Understood thereby below the larger face 7*a*, which is turned toward the first partial body 5, is the entire surface of second partial body 6 abutting on first partial body 5. It encompasses essentially that part of outer generated surface 7 of second partial body 6 which projects into the groove of first partial body 5. The smaller face 7*d* is the face of second partial body 6 turned away from first partial body 5. It extends approximately at right angles to the body longitudinal axis. The outer generated surface would be the generated surface of a truncated cone, tapering from first partial body 5 towards the smaller face, if the circumferential constriction 7*b*, 7*c* were not present. Formed by this circumferential constriction are essentially an annular surface 7*b* and a circumferential constriction generated surface 7*c*. Annular surface 7*b* thus serves, together with smaller face 7*d*, the transmission of the prestressing forces from second partial body 6 to part of the structure 9. Circumferential constriction generated surface 7*c* joins smaller face 7*d* at an angle and extends in the axial direction of the body toward annular surface 7*b*. It connects the outer circumferential line of smaller face 7*d* with the inner circumferential line of annular surface 7*b*. Circumferential constriction generated surface 7*c* advantageously runs conically, as indicated by the extended line, the cone narrowing in the direction of annular surface 7*b* starting from smaller face 7*d*, in a variant preferred embodiment. Achieved through this measure is an enlargement of the active surfaces for transmission of prestressing forces, i.e. the sum of smaller face 7*d* and annular surface 7*b*. This would not be the case if the circumferential constriction generated surface 7*c* would run parallel to the body longitudinal axis, or if the cone extends farther toward annular surface 7*b*, as indicated by a broken line with the designation 7*c*.

Ribs, designated 28, extend in the area of the constriction, preferably evenly distributed about the circumference of the body in axial direction of the latter. By means of these ribs 28, the active surfaces serving transmission of prestressing forces can be enlarged further by addition of the parts of the face designated 7*e*.

Inner generated surface 8 of second partial body 6 forms a conical opening 19, whose larger diameter is nearest abutting surface 2. Inner generated surface 8 is lined with an essentially funnel-shaped plastic part 18, for example of polyethylene. The end of plastic part 18 turned toward abutting surface 2 thereby overlaps inner collar 11 of first partial body 5 at least partially. The end of plastic part 18 turned away from abutting surface 2 projects out of second partial body 6, and has a connecting means 20 on its front end to connect said plastic part to a further, funnel-shaped or tube-shaped plastic part 21. Connecting means 20 can enclose, for example, an inwardly projecting collar encircling the end of the plastic part. Further plastic part 21 has preferably on the end to be held firmly an encircling collar, turned outward, designated by 36. Further plastic part 21 is led from abutting surface 2 into conical opening 19 of the force transfer part until the two said collars 20, 36 are contiguous to one another. It is easily possible to design the said collars 20, 36 of the two plastic parts 18, 21 to lock by snapping together.

To prevent a longitudinal displacement of plastic part 18 within conical opening 19 of second partial body 6, outwardly projecting fixing means 24, 25 in the form of circumferential bulges which project into second partial body 6 are provided on the outer generated surface of funnel-shaped plastic part 18.

Foreseen on plastic part 18, which projects out of second partial body 6, in the end area turned away from abutting surface 2 is a device in the form of a grout inlet 22 to connect a vent or grout tube 23. Inside grout inlet 22 the wall of the plastic part is perforated to form a vent and/or grouting hole 33. Provided on first partial body 5 is a flange 31, projecting outwardly radially, which has a bore 32 through which vent or grout tube 23 is led and is fastened to said grout inlet 22.

The strength of second partial body 6 can be harmonized to a large extent with the strength of the concrete of part of the structure 9. This can take place, on the one hand, through a corresponding selection of the material of the mortar mass, and can, on the other hand, be achieved by providing reinforcement elements 10, for example fibrous reinforcement elements within second partial body 6.

Fabrication of the inventive force transfer body takes place advantageously in such a way that the prefabricated first partial body 5 is cast integrally with second partial body 6, or respectively second partial body 6 is cast in one piece with first partial body 5. During the casting step first partial body 5 and funnel-shaped plastic part 18 can thereby be used as form elements for a casting mould. To do this, prior to the casting step first partial body 5, which can have a projection 41 on its inner collar, is placed upon the correspondingly constructed end of funnel-shaped plastic part 18. Depending upon the quantity of mortar mass to be filled into the casting mould, the size of second partial body 6 can also be adjusted to the part of the structure to be constructed. The casting step can be carried out locally on the building site. Transport costs can thus be saved. It is also possible to fabricate the second partial body after concreting of the building. To do this the first partial body and the correspondingly constructed casting forms would be fixed to the concrete form of the part of the structure to be concreted. Following concreting, the hollow space between the casting moulds, preferably made of plastic, is injected with mortar mass.

A spiral reinforcement 26 which surrounds anchorage body 1 in part of the structure 9, can be disposed in a known way. It does not require special mention that in the force transfer body according to the invention means are foreseen, not shown in the figures, to fix the body to parts of the concrete form of the part of the structure to be constructed.

Figure 3:
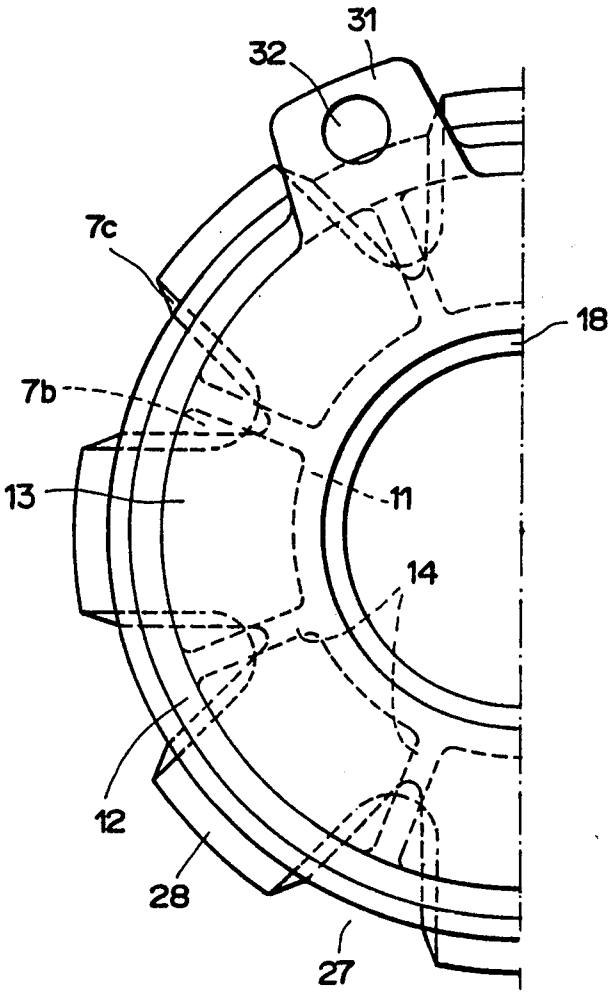
FIG. 3 is a top view of the force transfer body according to FIG. 2.

FIGS. 2 and 3 show the inventive force transfer body described in unembedded state. FIG. 2 presents a longitudinal section through the force transfer body, and FIG. 3 shows a plan of the force transfer body from the side of the first partial body.

Supplementary to the details already given, it will now be explained, using these figures, how the inclinations, slopes, etc. of individual surfaces or body parts are designed to advantage. As already mentioned, the outer, circumferential collar 12 of first partial body 5 extends outwardly away from ring 13. This is at an angle, designated 16, of 10° to 45°, preferably 20° to 30°, to longitudinal axis 15 of the force transfer body. The outer circumferential surfaces of ribs 28 likewise run outwardly inclined, seen from abutting surface 2. The angle of inclination, designated 17, amounts to 5° to 30°, preferably 10° to 20°, with respect to longitudinal axis 15. The lateral surfaces of the indentations 27 formed between every two ribs are given a rather strong sloping of 5° to 20°. Annular surface **7*b* and the frontal surface parts designated 7*e* of ribs 28 are so inclined that the lines of force of the force flow are emitted from the second partial body at nearly right angles, and can enter the part of the structure contiguous to the said frontal surfaces. The corresponding angles of inclination 42, 43** are 5° to 20° with respect to a plane conceived at a right angle to the longitudinal axis.

The sloping of inner generated surface 8 of second partial body 6 corresponds to the cone of funnel-shaped plastic part 18, and has an angle of inclination 35 of about 3°. Likewise inner circumferential collar 11 of first partial body 5 runs inclined corresponding to the said inner generated surface.

The sloping of the conical circumferential constriction generated surface **7*c*** amounts to about +/−5° up to +/−20° with respect to the longitudinal axis.

Second partial body 6 is designed in such a way that the mortar mass can be poured problem-free into the casting mould without any risk arising of air pockets, and in such a way that, with the finished force transfer body placed in the part of the structure to be concreted, hollow spaces containing air can hardly result during the concreting process.

By means of the selection made of the different surface inclinations and slopings, transmission of the concentrated force present on the anchor head to the part of the structure takes place evenly distributed over the second partial body.

Figure 4:
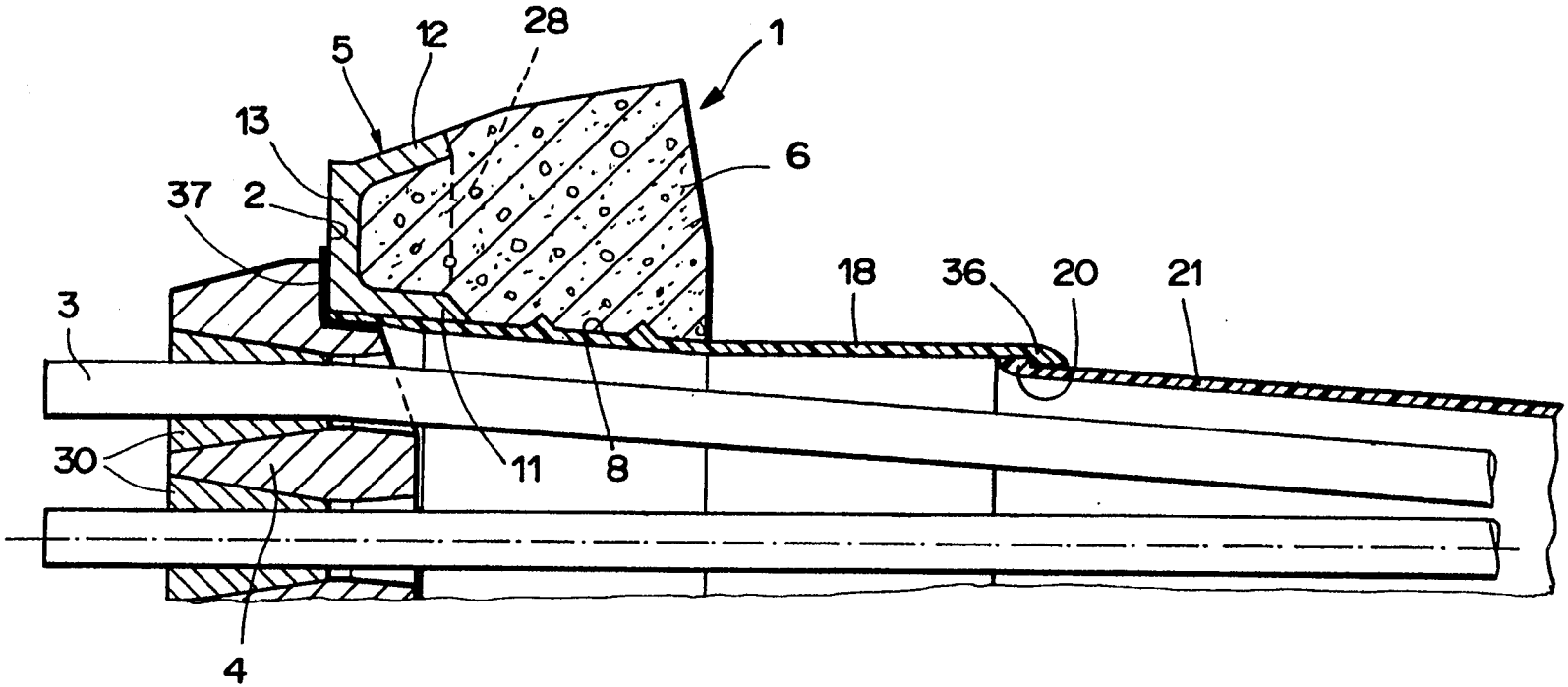
FIG. 4 is a cut-out of a longitudinal section through a modified embodiment of the inventive force transfer body according to FIG. 1; FIG.

Presented in FIG. 4 is a cut-out of a longitudinal section of the inventive force transfer body according to FIG. 1 in a modified embodiment. In essence funnel-shaped plastic part 18 totally overlaps inner collar 11 of first partial body 5. Inner generated surface 8 of second partial body 6 forms together with the inner generated surface of inner collar 11 of first partial body 5 a continuously running conical opening of the force transfer body. The end of plastic part 18 turned toward abutting surface 2 has a reduced wall strength in an end area which is not larger than the height of inner collar 11. Provided above this is an annular insulating interim layer 37, which has an L-shaped cross-section. The side thereof not overlapping plastic part 18 extends on the front end of force transfer body at least over a portion of abutting surface 2. Insulating interim layer 37, which is disposed between the surfaces adjacent to one another of anchor head 4 and of first partial body 5 of anchorage body 1, permits an electrically insulated placing of anchor head 4 on first partial body 5 of force transfer body 1. Cevolite can be used, for example, as an insulating material with a very great strength.

Figure 5:
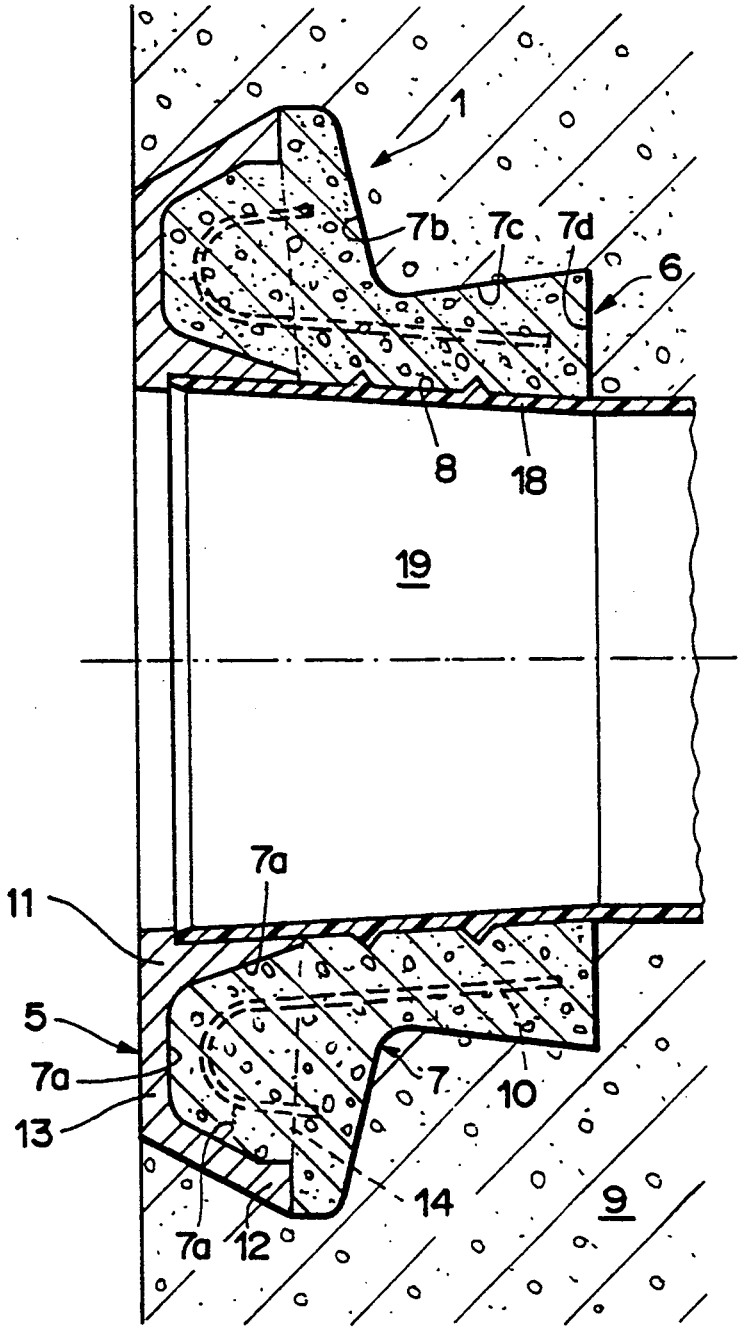

Shown in FIG. 5 is a second embodiment of the inventive force transfer body. This force transfer body corresponds to a simple design variation. Compared to the one just described, this one differs only in that there are no axially extending ribs in the area of the circumferential constriction **7*b*, 7*c***.

Figure 7:
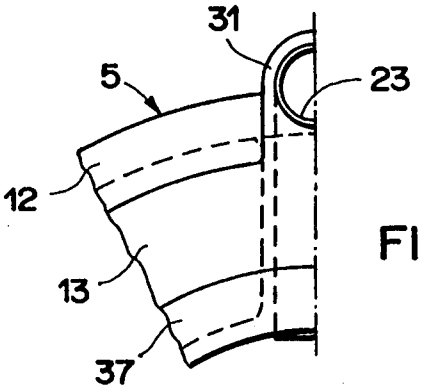
FIG. 7 is a partial top view of the force transfer body according to FIG. 6.
Figure 8:
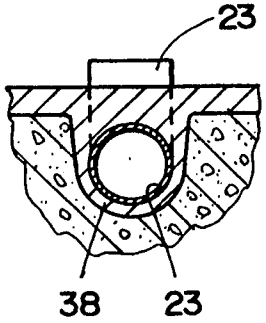
FIG. 8 is a section through a hose-lead passage of the force transfer body according to FIG. 6.
Figure 6:
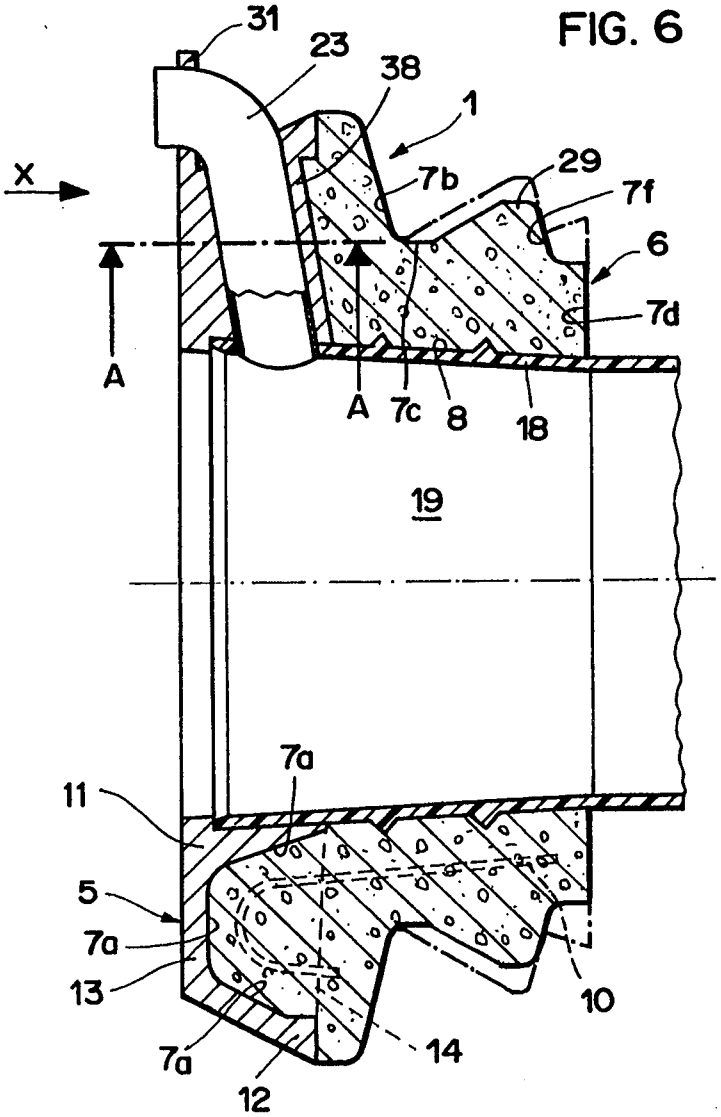
FIG. 6 is a longitudinal section through a third embodiment of a force transfer body according to the invention.

A further variation in this design is presented as a third embodiment of the inventive force transfer body in FIGS. 6, 7 and 8. This one differs from the constructions previously described in the given shape of second partial body 6 as well as in the arrangement of vent or grout tube 23.

Second partial body 6, also made of a castable material capable of hardening, has the form of a hollow body generated by rotation, with respect to its longitudinal axis 15. As described in the foregoing, it is cast in one piece with first partial body 5. For additional enlargement of the area of connection with the concrete of the part of the structure, into which it will be placed later, its outer generated surface has a circumferential bulge 29 extending outward radially, disposed in the area of circumferential constriction generated surface *7c*, instead of an alternation of axially running ribs and indentations distributed about the circumference. The bulge forms a further annular surface, designated as *7f*, on the side turned toward small face *7d*. This annular surface is also inclined, and runs approximately parallel to annular surface *7b*. The inclinations of the said annular surfaces and of the smaller face are also selected here in such a way that the emission of lines of forces coming out of second partial body 6 and entering a part of the structure is as orthogonal as possible. Here the given shape is also such that air pockets can hardly arise, neither during casting of the second partial body, nor during concreting of the completed force transfer body. Bulge 29 extends in radial direction at most as far as the maximum diameter of second partial body 6 determined by the larger face *7a*. The diameter of the bulge is preferably smaller than the largest diameter of the second partial body Compared to the first embodiment example, first partial body 5 has not only a flange 31 with a lead-through hole 32 to lead through or connect a vent or grout tube 23, but also has an integrated hose-lead passage 38 through which the vent or grout tube can be led into the conical opening 19 of the force transfer body in the area of first partial body 5. In addition a vent or grouting hole 33 is provided at the corresponding place in funnel-shaped plastic part 18 in the area overlapping with first partial body 5. Shown in FIGS. 7 and 8 is an example of the shape and arrangement of the said flange 31 and hoselead passage 38. The wall of hose-lead passage 38 can be at the same time a connecting element serving the reinforcement of inner and outer collars 11, 12.

In FIG. 6 a modified shape is indicated by a broken line in the area of the circumferential constriction. Here the circumferential constriction generated surface *7c*, without any bulge, would extend tapering conically toward larger face *7a*.

Although throughout the specification rotationally symmetrical bodies have been taken as a point of departure, other constructions, for example frusto-pyramidal bodies, would also be conceivable.

What is claimed is:

1. Force transfer body for an anchorage, comprising a body having an abutting surface serving as the contact surface for an anchor head containing individual members of a tension tendon, wherein said body is concreted within a concrete part of a structure, the force transfer body comprising at least first and second partial bodies, said first partial body being essentially annular and having first and second surfaces, with said first surface forming the abutting surface, said second partial body being disposed adjacent said second surface of the first partial body and coupled to said first partial body, the second partial body having the form of a hollow body with an outer surface and an inner generated surface and the outer surface being divided into two essentially annular faces and an outer generated surface, wherein the outer generated surface essentially represents the shell of a truncated cone whose larger face is turned towards the first partial body and wherein the outer generated surface has at least one radially circumferential constriction, an annular surface being formed by the circumferential constriction which, in addition to the smaller face, serves to convey prestressing forces to said concrete part of the structure.

2. Body according to claim 1, wherein the circumferential constriction comprises essentially, in addition to the said annular surface, a surface generated by the circumferential constriction, this surface adjoining the smaller face and extending in the axial direction of the body tapering conically toward the larger face.

3. Body according to claim 1, wherein the annular surface is inclined by at most 30° to a plane conceived at a right angle to the longitudinal axis of the body, the inner circumferential line of the annular surface being turned toward the smaller face.

4. Body according to claim 1, wherein the outer generated surface of the second partial body has in the area of the circumferential constriction at least one radially circumferential bulge extending outward, the largest radial dimension of the bulge being smaller than the largest radial dimension of the second partial body in the area of the face turned toward the first partial body.

5. Body according to claim 1, wherein axially extending ribs are disposed in the area of said circumferential constriction, distributed over the circumference.

6. Body according to claim 1, wherein the second partial body is made of a castable material capable of hardening, its strength being preferably less than that of the material of the first partial body and greater than that of the concrete of the part of the structure.

7. Body according to claim 1, wherein the inner generated surface of the second partial body is of conical form, the larger diameter of a conical aperture formed by the inner generated surface situated on the side of the second partial body toward the abutting surface.

8. Body according to claim 1, wherein the first partial body is preferably made of cast steel and has an essentially U-shaped cross-section, the two sides of the U forming an outer and an inner circumferential collar and the abutting surface being formed on the ring defined by the base, and the second partial body projecting into the constriction circumscribed by the surfaces of the ring and the collars turned toward each other.

9. Body according to claim 8, wherein the outer collar of the first partial body is directed outward from the ring and encloses an angle of 10° to 45° with the longitudinal axis of the body, and wherein ridges are provided, running essentially radially, connecting the two collars.

10. Body according to claim 1, wherein the first partial body has an outer and an inner circumferential collar with the inner generated surface of the second partial body being lined with an essentially funnel-shaped plastic part, the end of the plastic part turned towards the abutting surface overlapping at least partially the inner collar of the first partial body.

11. Body according to claim 10, wherein a fixing means is provided in operative connection with the second partial body to prevent an axial displacement of the plastic part with respect to the second partial body.

12. Body according to claim 10, wherein the first partial body and the plastic part are intended as moulding in fabrication of the second partial body.

13. Body according to claim 10, wherein the end area of the plastic part turned away from the abutting surface projects out of the conical aperture of the second partial body and is provided with means of connection with a further tube-shaped plastic part.

14. Body according to claim 13, wherein a device for connection of a grout tube is provided in the projecting end area of the plastic part.

15. Body according to claim 13, wherein a grout tube leads into the plastic part in the area of the inner generated surface.

* * * * *